US008094147B2

(12) United States Patent
Lee

(10) Patent No.: US 8,094,147 B2
(45) Date of Patent: Jan. 10, 2012

(54) DISPLAY DEVICE AND METHOD FOR TRANSMITTING CLOCK SIGNAL DURING BLANK PERIOD

(75) Inventor: Yong-Jae Lee, Yongin-si (KR)

(73) Assignee: Anapass Inc., Seoul (KR)

( * ) Notice: Subject to any disclaimer, the term of this patent is extended or adjusted under 35 U.S.C. 154(b) by 413 days.

(21) Appl. No.: 12/408,434

(22) Filed: Mar. 20, 2009

(65) Prior Publication Data

US 2009/0237395 A1 Sep. 24, 2009

(30) Foreign Application Priority Data

Mar. 20, 2008 (KR) ..... 10-2008-0025772
Jan. 30, 2009 (KR) ..... 10-2009-0007426

(51) Int. Cl.
*G09G 5/00* (2006.01)

(52) U.S. Cl. ..... 345/214

(58) Field of Classification Search ..... 345/214, 345/204, 94; 375/242, 240.26, 244; 711/158; 713/170, 176, 323
See application file for complete search history.

(56) References Cited

U.S. PATENT DOCUMENTS 6,369,516 B1 * 4/2002 Iketsu et al. ..... 315/169.3
6,954,201 B1 * 10/2005 Ludden et al. ..... 345/204
7,036,032 B2 * 4/2006 Mizuyabu et al. ..... 713/323
7,188,282 B2 * 3/2007 Walmsley ..... 714/718
7,257,163 B2 * 8/2007 Hwang et al. ..... 375/242
7,278,697 B2 * 10/2007 Plunkett ..... 347/5
7,362,298 B2 * 4/2008 Wakabayashi ..... 345/94
7,558,326 B1 * 7/2009 Lyle et al. ..... 375/244
7,592,829 B2 * 9/2009 Walmsley et al. ..... 326/8
7,770,008 B2 * 8/2010 Walmsley ..... 713/170
7,783,886 B2 * 8/2010 Walmsley ..... 713/176
7,818,519 B2 * 10/2010 Plunkett ..... 711/158
7,831,827 B2 * 11/2010 Walmsley ..... 713/168
2003/0048851 A1 * 3/2003 Hwang et al. ..... 375/240.26
2004/0201939 A1 * 10/2004 Shipton et al. ..... 361/104
2006/0052962 A1 * 3/2006 Shipton et al. ..... 702/106
2008/0165179 A1 * 7/2008 Ayres ..... 345/214
2008/0252635 A1 * 10/2008 Kim et al. ..... 345/214
2009/0278984 A1 * 11/2009 Suzuki et al. ..... 348/554

FOREIGN PATENT DOCUMENTS

KR 10-2003-0095112 12/2003
KR 10-2007-0078555 8/2007
WO WO 2007/035014 3/2007

* cited by examiner

*Primary Examiner* — Fred Tzeng
(74) *Attorney, Agent, or Firm* — Sherr & Vaughn, PLLC

(57) ABSTRACT

A display device includes a data line, a timing controller configured to apply a transmission signal corresponding to data bits to a data line during an active period in which the data bits are transmitted and apply a transmission clock signal to the data line during a blank period in which the data bits are not transmitted, and a data driver configured to sample the transmission signal (hereinafter, a reception signal) applied through the data line to recover the data bits and drive a display panel according to the recovered data bits. The display device can transmit a clock signal through the data line during the blank period.

18 Claims, 9 Drawing Sheets

POL
data line 500
ACT(blank period)
DATA_BIT
X X X

DISPLAY DEVICE AND METHOD FOR TRANSMITTING CLOCK SIGNAL DURING BLANK PERIOD

CROSS-REFERENCE TO RELATED APPLICATION

This application claims priority to and the benefit of Korean Patent Application No. 2008-0025772, filed Mar. 20, 2008, and 10-2009-0007426, filed Jan. 30, 2009, the contents of which are hereby incorporated herein by reference in its entirety.

BACKGROUND

1. Field of the Invention

The present invention relates to a display device and method.

2. Discussion of Related Art

A Point-to-Point Differential Signaling (PPDS) method has been disclosed by National Semiconductor Corporation as a conventional technique of an interface between a timing controller and a data driver of a display device.

FIG. 1 is a diagram illustrating PPDS. Referring to FIG. 1, in PPDS, an independent data line 3 is connected between a timing controller 1 and a data driver 2. The PPDS has smaller electromagnetic interference (EMI) and a smaller number of signal lines, compared to conventional Reduced Swing Differential Signaling (RSDS) and mini-Low Voltage Differential Signaling (LVDS) methods. A clock line 4 and a load line 5 are connected between the timing controller 1 and the data driver 2. The clock line 4 and the load line 5 are commonly connected to the data driver 2. Since a differential signaling is used to transmit a data signal and a clock signal, the data line 3 and the clock line 4 are configured as a differential pair, respectively.

SUMMARY OF THE INVENTION

The present invention is directed to a display device and method in which a clock signal is transmitted through a data line during a blank period without requiring a separate clock line.

The present invention is also directed to a display device and method in which a clock signal is transmitted through a data line, whereby an EMI component generated from a separate clock line is removed.

The present invention is also directed to a display device and method in which a clock signal and a control bit are transmitted together through a data line during a blank period.

According to an aspect of the present invention, there is provided a display device, including: a data line; a timing controller configured to apply a transmission signal corresponding to data bits to a data line during an active period in which the data bits are transmitted and apply a transmission clock signal to the data line during a blank period in which the data bits are not transmitted; and a data driver configured to sample the transmission signal (hereinafter, a reception signal) applied through the data line to recover the data bits and drive a display panel according to the recovered data bits.

According to another aspect of the present invention, there is provided a display method, including: at a timing controller, transmitting a transmission clock signal through a data line during a blank period in which data bits are not transmitted; at the timing controller, transmitting a transmission signal corresponding to the data bits through the data line during an active period in which the data bits are transmitted; at a data driver, receiving the transmission signal through the data line and sampling the received transmission signal according to the generated sampling clock signal to recover the data bits; and at the data driver, driving a display panel according to the recovered data bits.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Figure 1:
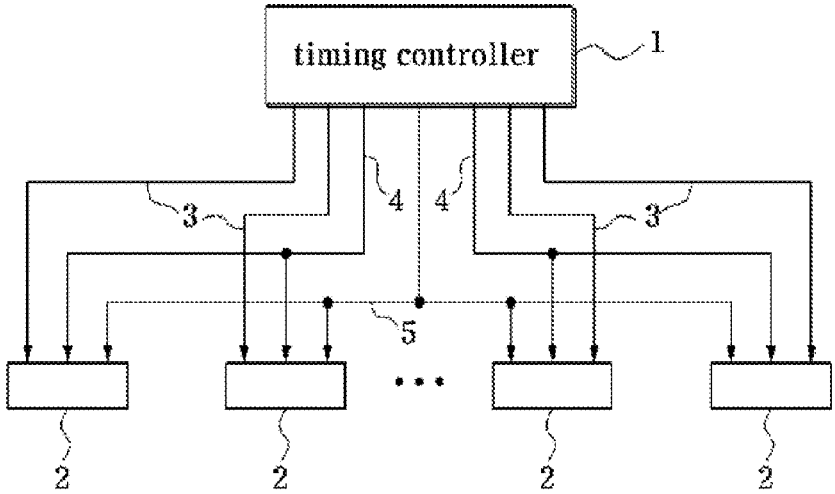
FIG. 1 (Related Art)
FIG. 1 is a diagram illustrating PPDS according to a conventional art.
Figure 2:
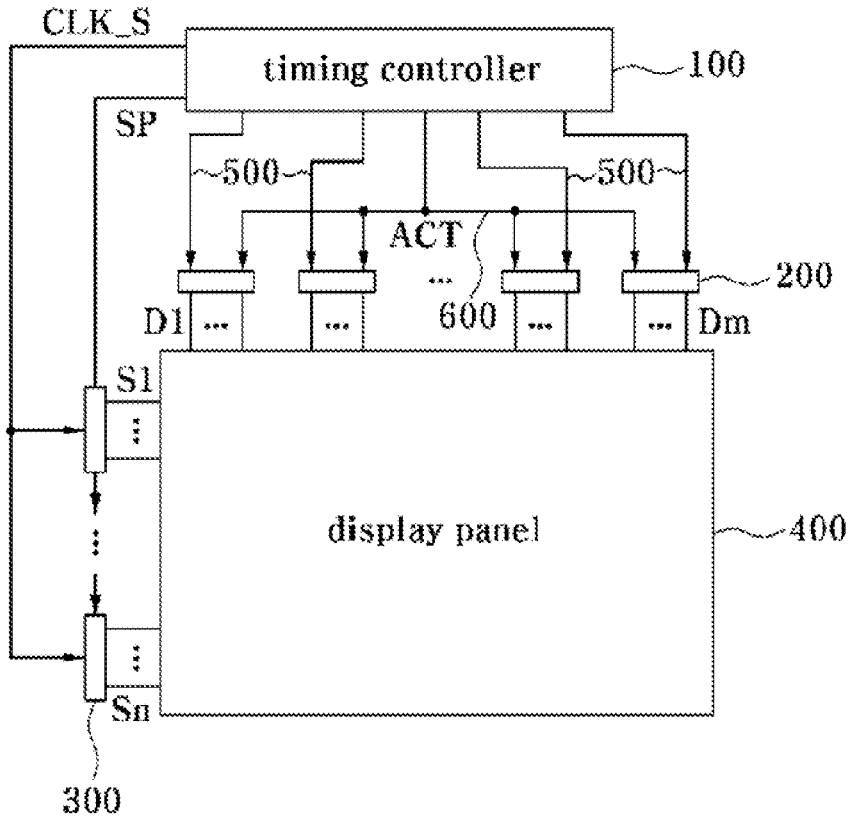
FIG. 2 is a block diagram of a display device according to an exemplary embodiment of the present invention.

FIG. 2 is a block diagram of a display device according to an exemplary embodiment of the present invention.

Referring to FIG. 2, a display device includes a timing controller 100, data drivers 200, scan drivers 300, and a display panel 400.

The timing controller 100 applies a transmission signal corresponding to RGB image data bits and control bits to each data line 500 during an active period in which data bits are transmitted. The timing controller 100 applies a transmission clock signal to each data line 500 during a blank period in which data bits are not transmitted. The timing controller 100 includes a signal corresponding to at least one control bit in the transmission clock signal and applies the transmission clock signal with the control bit to each data line 500, during the blank period. The transmission clock signal can have a cycle corresponding to an integer times of a period corresponding to one bit of the transmission signal, and the control bit can be located immediately next to a falling edge of the transmission clock signal.

The timing controller 100 includes a comma pattern in the transmission clock signal and applies the transmission clock signal with the comma pattern to each data line 500. The comma pattern can be located immediately next to a falling edge of the transmission clock signal.

The timing controller 100 provides the data driver 200 with an active signal ACT representing the blank period or the active period. The timing controller 100 provides the scan driver 300 with a clock signal CLK_S and a start pulse SP.

The data driver 200 generates a sampling clock signal according to the transmission clock signal (hereinafter, "a reception clock signal") applied through the data line 500 during the blank period. The data driver 200 samples the transmission signal (hereinafter, "reception signal") transmitted through the data line 500 during the active period according to the sampling clock signal and recovers the RGB image data bits and the control bits. The data driver 200 samples the transmission clock signal with the control bits applied through the data line 500 during the blank period according to the sampling clock signal and recovers the control bits.

The data driver 200 generates a control signal corresponding to the recovered control bits and applies data signals corresponding to the recovered data bits to the display panel 400 according to the control signal. The data driver 200 can distinguish between the active period and the blank period through the active signal ACT.

The scan driver 300 applies scan signals to the display panel 400 according to the clock signal CLK_S and the start pulse SP which are provided from the timing controller 100.

The display panel 400 displays an image according to the scan signals S1 to Sn which are provided from the scan drivers 300 and the data signals D1 to Dm which are provided from the data drivers 200. Various types of display panels including, but not limited to, a Liquid Crystal Display (LCD) panel, a Plasma Display Panel (PDP) panel, and an Organic Electro-Luminescence Display (OELD) panel can be used as the display panel 400.

Signal-ended signaling which uses a single wire line or differential signaling which uses two wire lines such as an LVDS can be used as a method for transmitting the transmission signal and the transmission clock signal from the timing controller 100 to each data driver 200.

Figure 3:
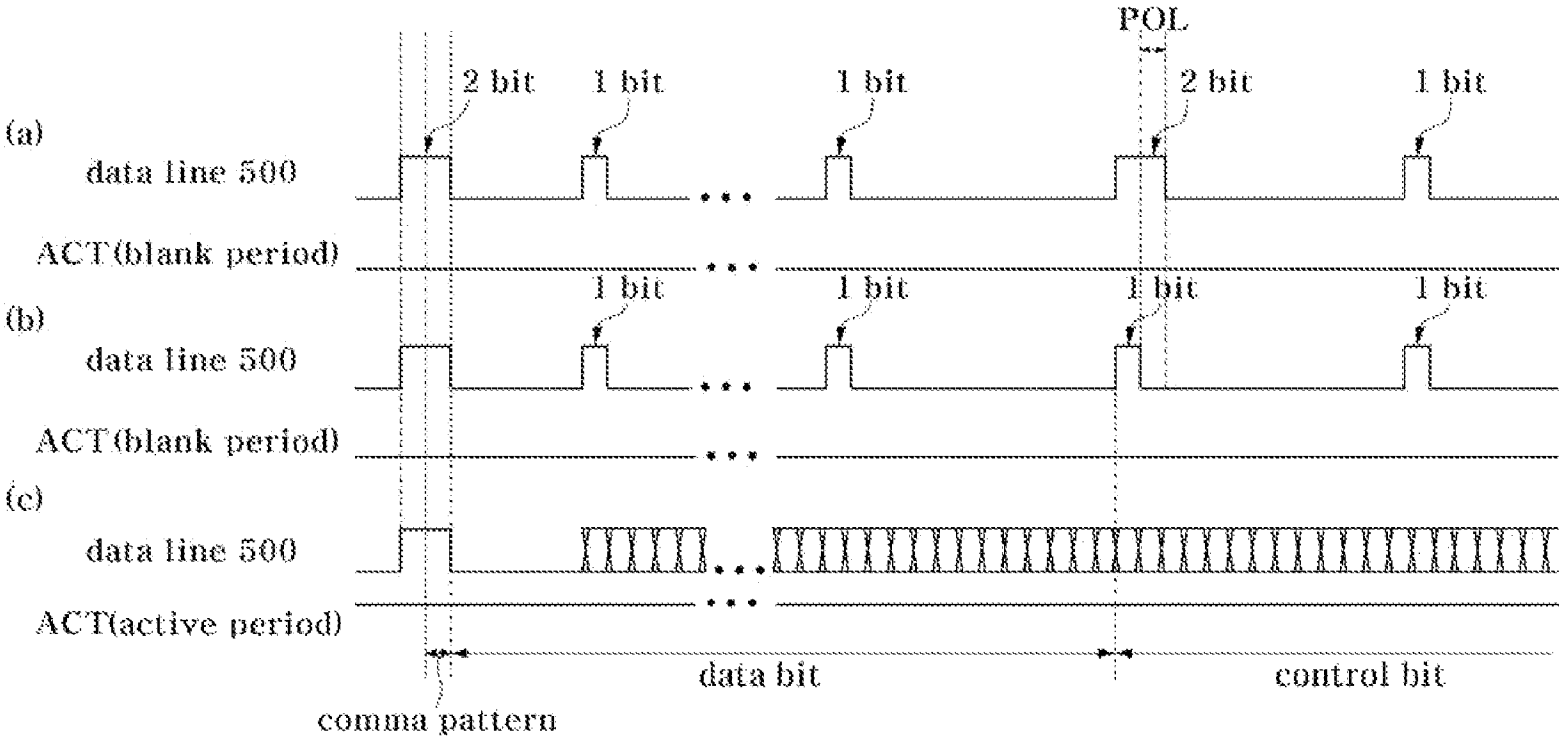
FIG. 3 is a diagram illustrating a transmission clock signal and a transmission signal transmitted through the data line.

FIG. 3 is a diagram illustrating the transmission clock signal and the transmission signal which are transmitted through the data line.

(a) of FIG. 3 illustrates examples of a signal and the active signal ACT which are transmitted through the data line 500 during the blank period, (b) of FIG. 3 illustrates another examples of a signal and the active signal ACT which are transmitted through the data line 500 during the blank period, and (c) of FIG. 3 illustrates examples of a signal and the active signal ACT which are transmitted through the data line 500 during the active period.

Referring to (c) of FIG. 3, the timing controller 100 includes the comma pattern in the transmission clock signal and applies the transmission clock signal with the comma pattern to the data line 500, and then sequentially applies a transmission signal corresponding to RGB image data bits and a transmission signal corresponding to control bits. For example, the comma pattern can be configured by at least one bit and be located immediately next to a falling edge of the transmission clock signal. The comma pattern is located immediately next to the falling edge of the transmission clock signal in order to maintain a form of the transmission clock signal.

The data driver 200 detects the comma pattern, samples the RGB image data bits from the transmission signal applied next to the comma pattern, and samples the control bits from the transmission signal applied after a period corresponding to a previously set clock elapses.

In FIG. 3, an active signal ACT of a low level represents the blank period, and an active signal ACT of a high level represents the active period. Unlike the example shown in FIG. 3, information representing whether or not it is the blank period can be transmitted by various methods. For example, a period lasting from after an active signal of a pulse form is applied until a previously set time can correspond to the active period, and a remaining period can correspond to the blank period.

Referring to (a) and (b) of FIG. 3, the timing controller 100 applies the transmission clock signal to the data line 500. The timing controller 100 includes the comma pattern in the transmission clock signal and applies the transmission clock signal with the comma pattern to the data line 500, and includes a signal corresponding to the control bit in the transmission clock signal and applies the transmission clock signal with the signal corresponding to the control bit to the data line 500. The signal corresponding to the control bit can be located immediately next to the falling edge of the transmission clock signal. The signal corresponding to the control bit is located immediately next to the falling edge of the transmission clock signal to maintain a form of the transmission clock signal. For example, the control bit can include a polarity information bit POL as shown in (a) and (b) of FIG. 3. If the blank period lasts for two or more lines, the polarity information bit POL can have either of a HIGH level as shown in (a) of FIG. 3 and a LOW level as shown in (b) of FIG. 3.

The data driver 200 detects the comma pattern and samples the control bit included in the transmission clock signal after a period corresponding to a previously set clock elapses from the comma pattern.

Figure 4:
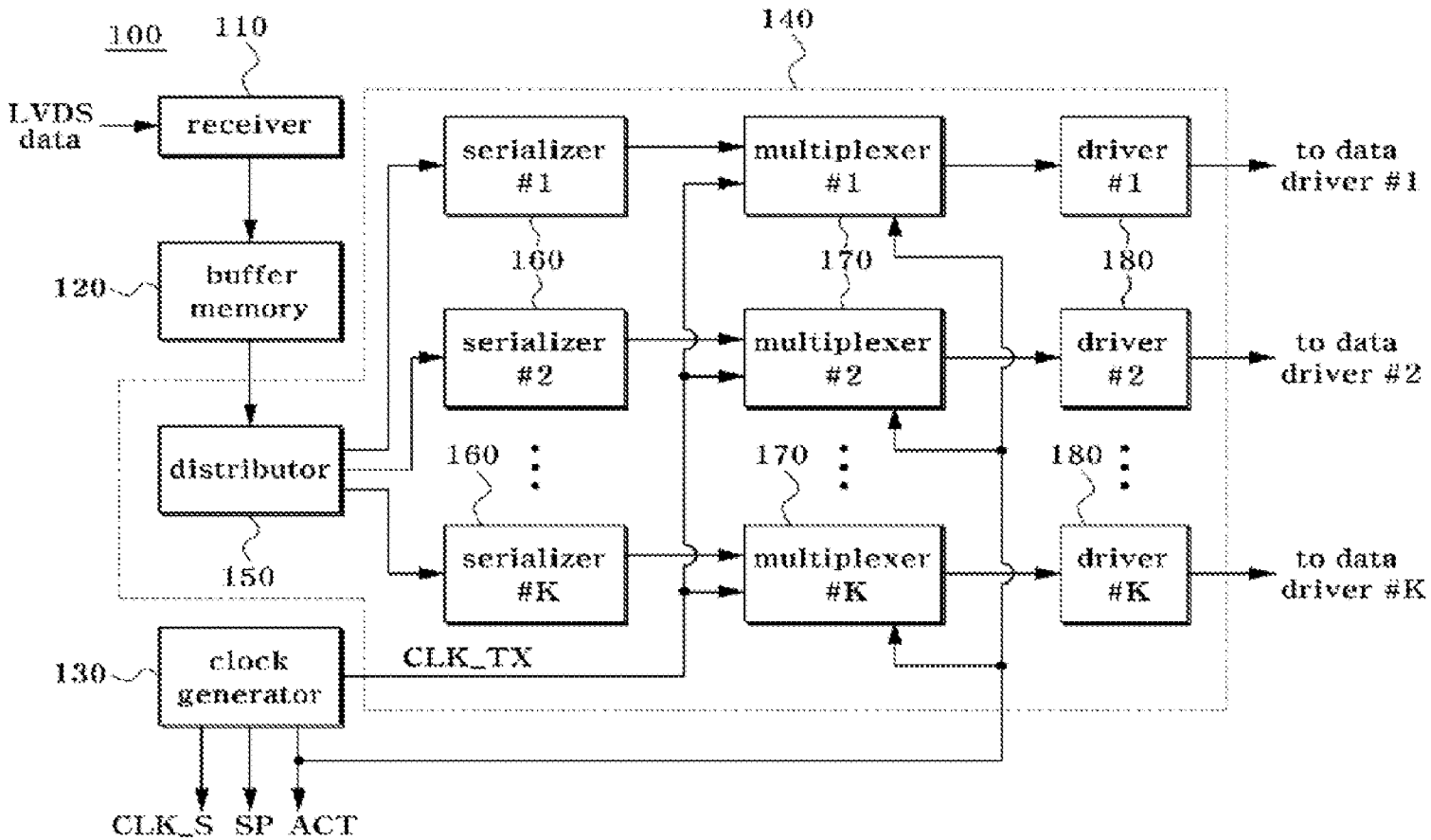
FIG. 4 is a block diagram of a timing controller shown in FIG. 2.

FIG. 4 is a block diagram of the timing controller shown in FIG. 2.

Referring to FIG. 4, the timing controller 100 can include a receiver 110, a buffer memory 120, a clock generator 130, and a transmitter 140.

The receiver 110 receives RGB image data from an external portion and converts the RGB image data into a Transistor-Transistor Logic (TTL) signal. A reception signal input to the timing controller 100 can include, but is not limited to, a signal of an LVDS form shown in FIG. 4 or a Transition Minimized Differential Signaling (TMDS) form. The TTL signal is a digital signal and has a large voltage swing of a power voltage level unlike an LVDS signal having a small voltage swing of 0.35V.

The buffer memory 120 temporarily stores the image data converted into the TTL signal and then outputs the image data.

The clock generator 130 generates the start pulse SP and the clock signal CLK_S which are to be transmitted to the scan driver 300 using synchronizing signals input from an external portion. The clock generator 130 generates the active signal ACT which is to be transmitted to the data driver 200 and the transmitter 140 using synchronizing signals input from an external portion. The clock generator 130 generates the transmission clock signal CLK_TX including the control bit shown in (b) and (c) of FIG. 3 using synchronizing signals input from an external portion and an inversion setting signal.

The transmitter 140 receives the image data output from the buffer memory 120 and the signals ACT and CLK_TX transmitted from the clock generator 130, and outputs the transmission signal or the transmission clock signal CLK_TX which is to be transmitted to each data driver 200 to the data line 500.

The transmitter 140 can include a distributor 150, serializers 160, multiplexers 170, and drivers 180. In FIG. 4, K denotes the number of data drivers 200 connected to the timing controller 100.

The distributor 150 distributes digital bits corresponding to the image data output from the buffer memory 120 to the serializers 160. The serializer 160 outputs serialized transmission bits corresponding to the digital bits transmitted from the distributor 150. The multiplexer 170 outputs the serialized transmission bits transmitted from the serializers 160 during the active period and outputs the transmission clock signal CLK_TX transmitted from the clock generator 130 during the blank period. The driver 180 drives the data line 500 according to a signal output from the multiplexer 170. The driver 180 can output an LVDS signal which is a differential signal as one example or a single signal as another example.

Figure 5:
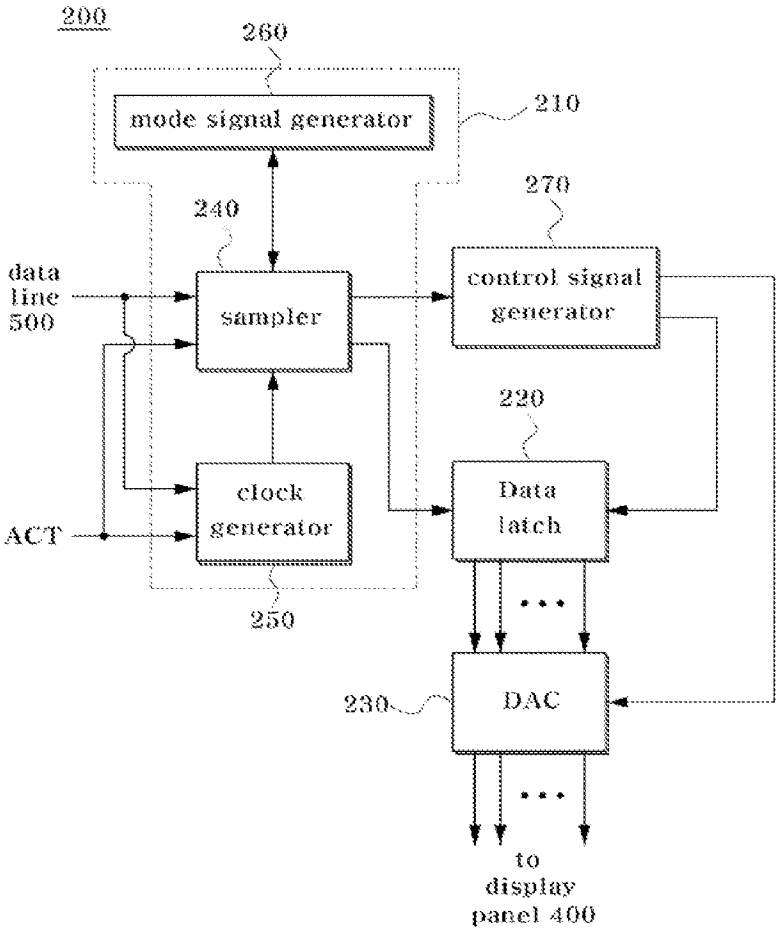
FIG. 5 is a block diagram of a data driver shown in FIG. 2.

FIG. 5 is a block diagram of the data driver shown in FIG. 2.

Referring to FIG. 5, the data driver 200 can include a receiver 210, a data latch 220, a digital-to-analog (DA) converter 230, and a control signal generator 270.

The receiver 210 receives the reception clock signal through the data line 500 and generates the sampling clock signal CLK_SAM according to the reception clock signal, during the blank period. The receiver 210 detects the comma pattern and samples the control bit included in the reception clock signal after a period corresponding to a previously set clock elapses from the comma pattern to recover the control bit, during the blank period.

The receiver 210 receives the reception signal through the data line 500 and samples the reception signal according to the sampling clock signal CLK_SAM to recover the data bits and the control bits from the reception signal, during the active period. The receiver 210 can detect the comma pattern of the reception clock signal and recover control bits from the reception signal received after a period corresponding to a previously set clock elapses from the comma pattern.

The receiver 210 can include a sampler 240, a clock generator 250, and a mode signal generator 260.

The clock generator 250 generates the sampling clock signal CLK_SAM according to the reception clock signal. In further detail, the clock generator 250 changes a phase of the sampling clock signal CLK_SAM according to the reception clock signal during the blank period and constantly maintains a phase of the sampling clock signal CLK_SAM during the active period.

The mode signal generator 260 detects the comma pattern and generates a mode signal corresponding to the detected comma pattern. For example, the mode signal generator 260 can generate a mode signal which rises when the comma pattern is detected and falls after a period corresponding to a previously set clock elapses.

The sampler 240 samples the reception signal according to the sampling clock signal CLK_SAM to recover data bits and control bits during the active period. The sampler 240 samples the reception signal to recover data bits and provides the recovered data bits to the data latch 220 while the mode signal has a high level. The sampler 240 samples the reception signal to recover control bits and provides the recovered control bits to the control signal generator 270 while the mode signal has a low level.

The sampler 240 samples the control bit included in the reception clock signal according to the sampling clock signal CLK_SAM while the mode signal has a low level to recover the control bit during the blank period. For example, the sampler 240 can recover the polarity information bit during the blank period.

The control signal generator 270 generates a control signal corresponding to the recovered control bit and provides the control signal to the data latch 220 or the DA converter 230. For example, the control signal generator 270 generates a polarity control signal corresponding to the polarity information bit and provides the polarity control signal to the DA converter 230. For example, the control signal generator 270 generates a polarity control signal with a high level when the polarity information bit is "1" and a polarity control signal with a low level when the polarity information bit is "0".

The data latch 220 sequentially stores data bits output from the sampler 240 and outputs the data bits in parallel according to the load signal.

The DA converter 230 converts data bits output from the data latch 220 into analog data based on a gamma reference voltage. First, the DA converter 230 generates a plurality of positive voltages based on a positive gamma reference voltage and a plurality of negative voltages based on a negative gamma reference voltage. Next, the DA converter 230 selects one of a plurality of positive voltages and one of a plurality of negative voltages according to data bits output from the data latch 220. The DA converter 230 selects either of a positive voltage and a negative voltage according to the polarity control signal and transmits the selected voltage to the display panel 400.

Figure 6:
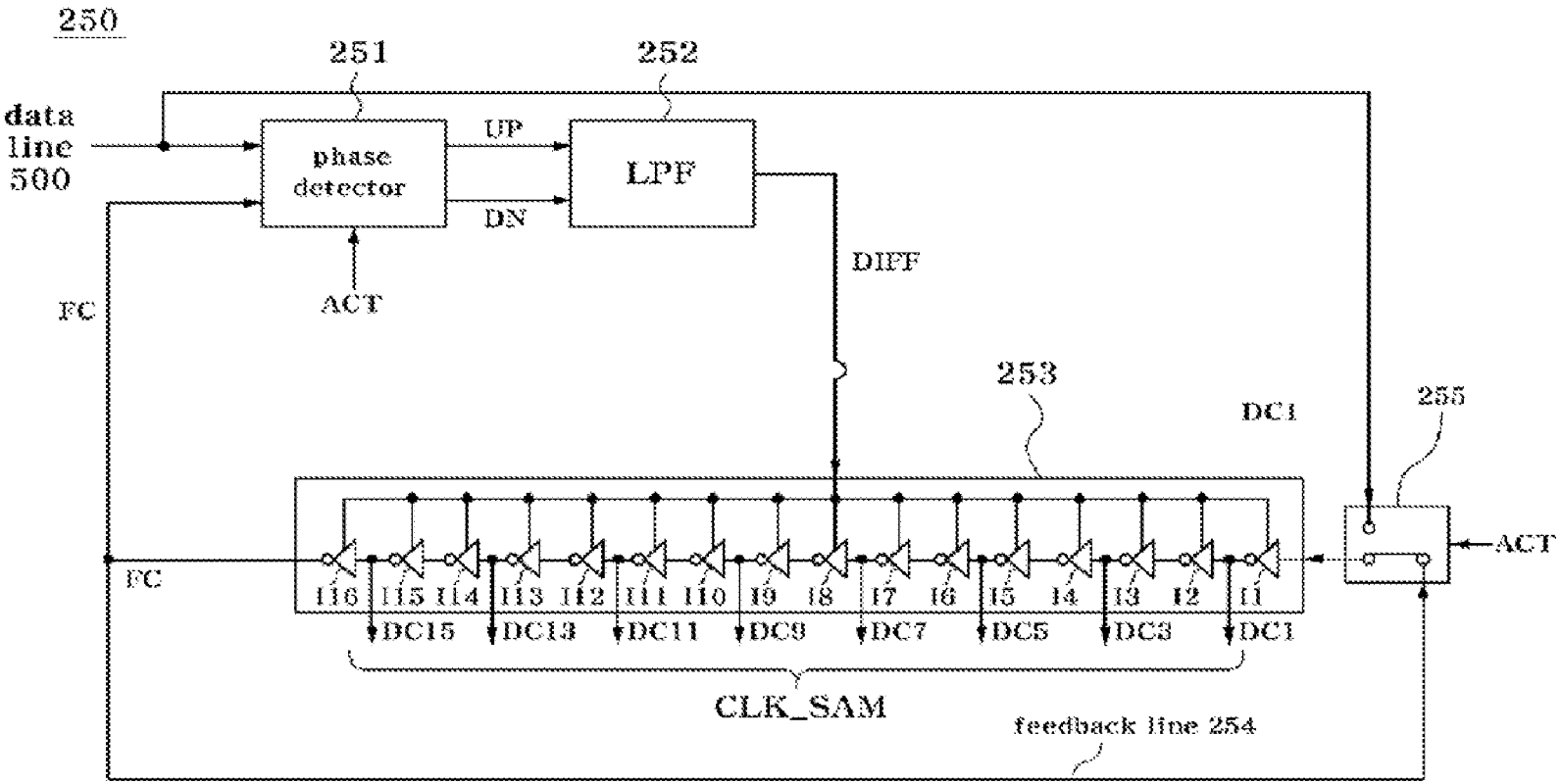
FIG. 6 is a diagram illustrating an example of a clock generator shown in FIG. 5.

FIG. 6 is a diagram illustrating an example of the clock generator shown in FIG. 5.

Referring to FIG. 6, the clock generator 250 can include a phase detector 251, a low-pass filter (LPF) 252, a delay line 253, a feedback line 254, and a switch 255.

The phase detector 251 detects a phase difference between the reception clock signal and a feedback clock signal FC. The phase detector 251 outputs signals UP and DN corresponding to a phase difference between the reception clock signal and the feedback clock signal FC during the blank period and outputs signals UP and DN (both UP and DN are zero (0)) corresponding to no phase difference during the active period.

The low-pass filter 252 removes a high-frequency component of the signals UP and DN corresponding to the phase difference output from the phase detector 251. For example, a charge pump can be used as the low-pass filter 252.

The delay line 253 has a delay corresponding to the phase difference DIFF, in which a high-frequency component is removed, output from the low-pass filter 252. The delay line 253 receives the reception clock signal during the blank period and the feedback clock signal FC during the active period. The delay line 253 outputs the feedback clock signal FC.

The delay line 253 can include a plurality of inverters I1 to I16. Each delay of each of a plurality of inverters I1 to I16 is adjusted according to the signal DIFF output from the low-pass filter 252. Each of a plurality of inverters I1 to I16 has a delay corresponding to about a half of a period corresponding to one bit of the transmission signal (T1/2). First, third, fifth, seventh, ninth, eleventh, thirteenth, and fifteenth delay clocks DC1, DC3, DC5, DC7, DC9, DC11, DC13, and DC15 respectively output from first, third, fifth, seventh, ninth, eleventh, thirteenth, and fifteenth inverters I1, I3, I5, I7, I9, I11, I13, and I15 are output to the sampler 240 as the sampling clock signal CLK_SAM.

The sampler 240 samples the reception signal using the first, third, fifth, seventh, ninth, eleventh, thirteenth, and fifteenth delay clocks DC1, DC3, DC5, DC7, DC9, DC11, DC13, and DC15 to recover eight data bits and control bits from the reception signal during a period corresponding to one cycle of the reception clock signal, during the active period.

The sampler 240 samples the control bits using one or more of the first, third, fifth, seventh, ninth, eleventh, thirteenth, and fifteenth delay clocks DC1, DC3, DC5, DC7, DC9, DC11, DC13, and DC15 during the blank period. For example, the sampler 240 can sample the polarity information bit using the first delay clock DC1.

The feedback line 254 connects the delay line 253 with the switch 255 and feeds the feedback clock signal FC output from the delay line 253 back to the delay line 253 through the switch 255.

The switch 255 inputs the reception clock signal to the delay line 253 during the blank period and the feedback clock signal FC to the delay 253 during the active period.

Figure 7:
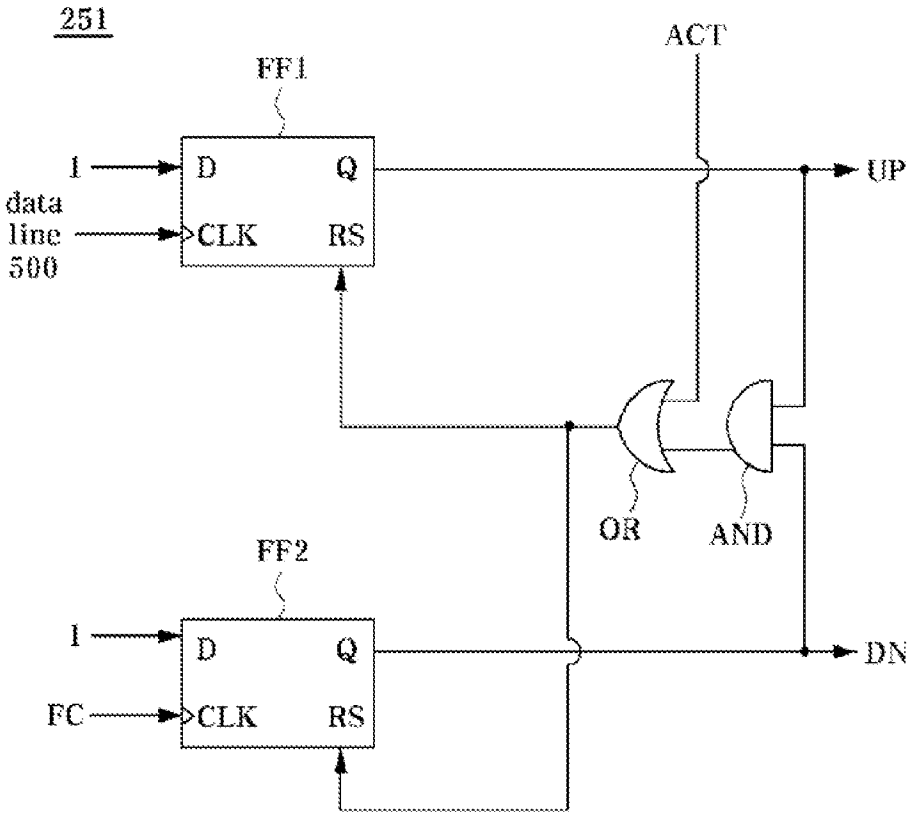
FIG. 7 is a diagram illustrating an example of a phase detector shown in FIG. 6.

FIG. 7 is a diagram illustrating an example of the phase detector shown in FIG. 6.

Referring to FIG. 7, the phase detector 251 can include a first flip-flop FF1, a second flip-flop FF2, a logical product operator AND, and a logical sum operator OR.

The first flip-flop FF1 and the second flip-flop FF2 are positive-edge-triggered D flip-flops, respectively. The data line 500 is connected to a clock terminal CLK of the first flip-flop FF1. Therefore, during the blank period, the first flip-flop FF1 outputs "1" when the reception clock signal applied to the data line 500 rises and "0" when an output of the logical sum operator OR applied to a reset terminal RS is "1". The second flip-flop FF2 outputs "1" when the feedback clock signal FC applied to the clock terminal CLK rises and "0" when an output of the logical sum operator OR applied to the reset terminal RS is "1". The logical product operator AND performs a logical product (AND) operation of outputs of the first and second flip-flops, and the logical sum operator OR performs a logical sum (OR) operation of an output of the logical product operator AND and the active signal ACT.

The phase detector 251 shown in FIG. 7 outputs a signal corresponding to a phase difference between a signal (the reception clock signal) transmitted through the data line 500 and the feedback clock signal when the active signal is "0" (that is, during the blank period). The phase detector 251 outputs signals (UP=0, DN=0) corresponding to no phase difference regardless of a phase difference between a signal (the reception signal) transmitted through the data line 500 and the feedback clock signal FC when the active signal is "1" (that is, during the active period).

According to the exemplary embodiment of the present invention from FIG. 2 to FIG. 7, the timing controller 100 does not transmit clock information to the data driver 200 during the active period. Therefore, there is a possibility that the data driver 200 cannot perform accurate sampling since the sampling clock signal CLK_SAM is not synchronized with the reception signal during the active period. In order to prevent this problem, the timing controller 100 can transmit clock information to the data driver 200 through the data line 500 even during the active period. For example, the timing controller 100 can transmit a transmission signal having a periodic transition to the data driver 200 during the active period.

Figure 8:
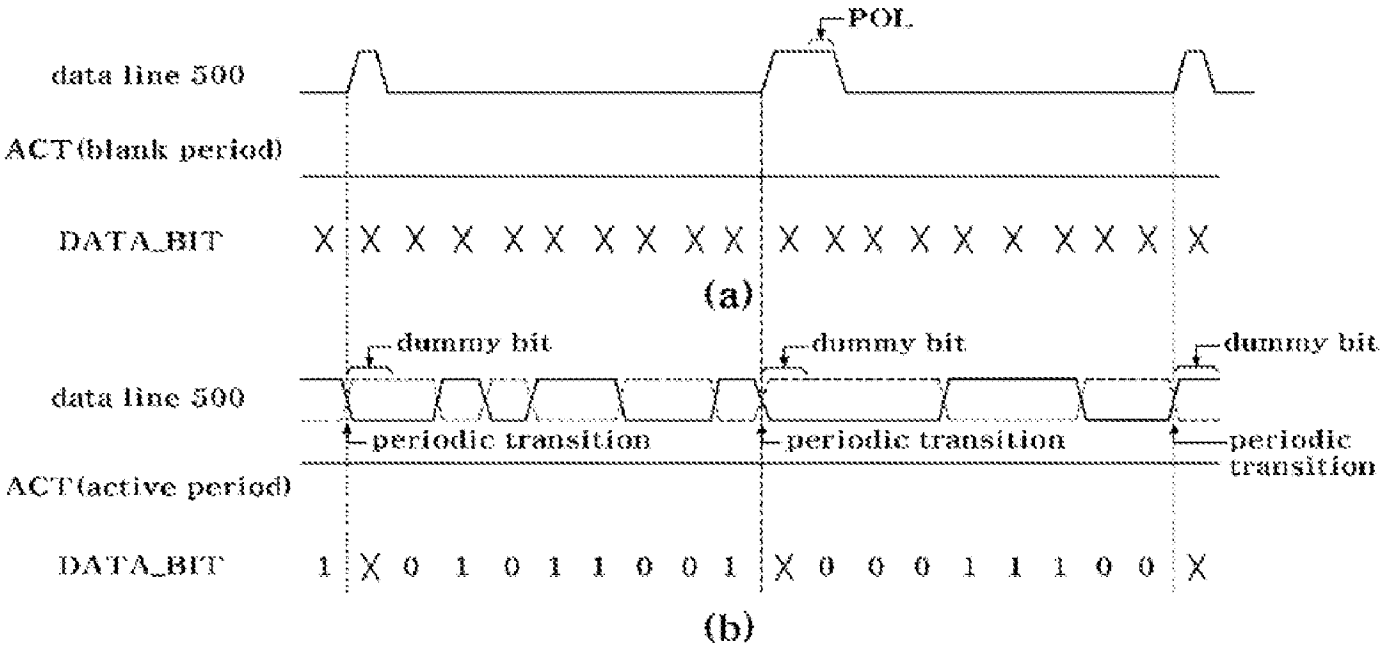
FIG. 8 is a diagram illustrating a transmission clock signal and a transmission signal when the transmission signal has a periodic transition.

FIG. 8 is a diagram illustrating the transmission clock signal and the transmission signal when the transmission signal has a periodic transition.

(a) of FIG. 8 illustrates examples of a signal, the active signal ACT and data bits DATA_BIT which are transmitted to the data line 500 during the blank period, and (b) of FIG. 8 illustrate examples of a signal, the active signal ACT and data bits DATA_BIT which are transmitted to the data line 500 during the active period.

Referring to (a) of FIG. 8, the timing controller 100 applies the transmission clock signal to the data line 500 during the blank period. The timing controller 100 includes a control bit such as the polarity information bit POL in the transmission clock signal and applies the transmission clock signal with the control bit to the data line 500.

Referring to (b) of FIG. 8, the timing controller 100 applies the transmission signal which corresponds to data bits and has a periodic transition to the data line 500 during the active period. For example, a cycle of the periodic transition can be identical to a cycle of the transmission clock signal as shown in FIG. 8. However, unlike FIG. 8, a cycle of the periodic transition can be an integer times of a cycle of the transmission clock signal, or a cycle of the transmission clock signal can be an integer times of a cycle of the periodic transition.

The periodic transition can be elicited by a dummy bit which is periodically inserted. For example, the dummy bit can have a different value from a data bit immediately preceding the dummy bit as shown in FIG. 8. However, unlike FIG. 8, the dummy bit can have a different value from a data bit immediately following the dummy bit. The periodic transition can be elicited by two dummy bits which are periodically inserted, and in this case, the dummy bits can have a fixed value (i.e., 01 or 10).

The timing controller 100 can periodically include at least one dummy bit in data bits and generate a transmission signal corresponding to data bits in which the dummy bit is included, i.e., the transmission signal having a periodic transition. For example, the transmission signal having the periodic transition can be generated by first outputting a dummy bit and then sequentially outputting data bits input in parallel through the serializer 160 of FIG. 4. In this case, the dummy bit has a value corresponding to an inversion of a last bit among data bits which are output immediately before the dummy bit.

Figure 9:
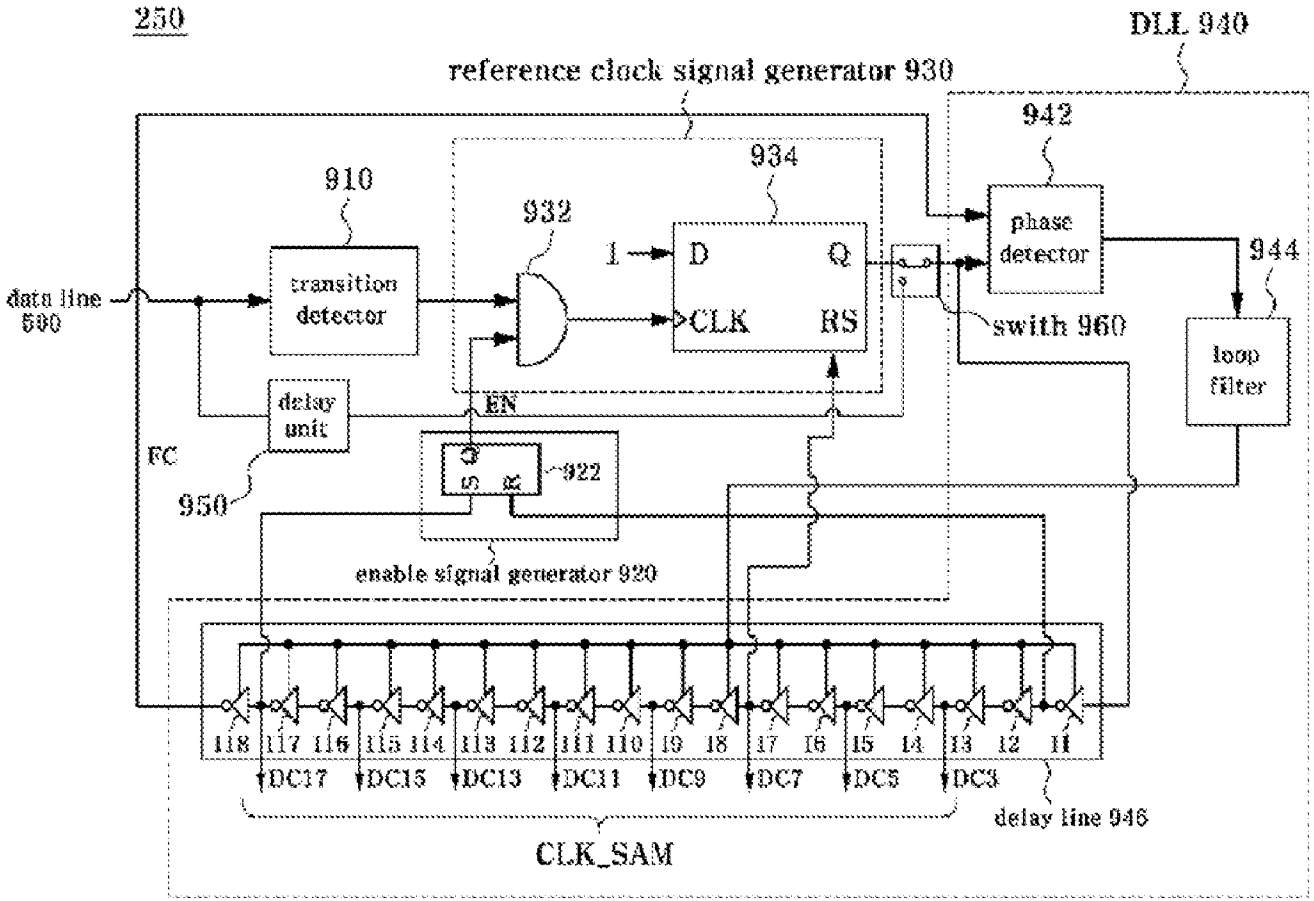
FIG. 9 is a diagram illustrating another example of a clock generator shown in FIG. 5.

FIG. 9 is a diagram illustrating another example of the clock generator shown in FIG. 5.

The data driver 200 can generate a sampling clock according to a periodic transition of the reception clock signal and the reception signal using a clock generator shown in FIG. 9 instead of the clock generator 250 shown in FIG. 4.

Referring to FIG. 9, the clock generator 250 can include a transition detector 910, an enable signal generator 920, a reference clock signal generator 930, a delay-locked loop (DLL) 940, a delay unit 950, and a switch 960. The reference clock signal generator 930 can include a logical product (AND) operator 932 and a flip-flop 934, and the DLL 940 can include a phase detector 942, a loop filter 944, and a delay line 946.

The transition detector 910 receives the reception signal and detects a transition of the reception signal during the active period. For example, the transition detector 910 can detect a transition of the reception signal by delaying the reception signal and performing an exclusive logical sum (XOR) operation of the reception signal and the delayed reception signal.

The enable signal generator 920 generates an enable signal EN which is a signal which enables the reference clock signal generator 930 to generate a reference clock signal according to a periodic transition by a dummy bit among many transitions of the reception signal detected by the transition detector 910.

For example, let us assume that a time point at which a periodic transition is performed is T3 and a period corresponding to one data bit or dummy bit of the reception signal is T1. Preferably, a start time point T_START of the enable signal and an end time point T_END of the enable signal satisfy the following Formula I:

$$T3-T1<T3_START<T$$

$$T3<T_END<T3+T1 \qquad \text{[Formula 1]}$$

If the start time point T_START is equal to or less than "T3−T1" or the end time point T_END is equal to or more than "T3+T1", and an undesired transition other than the periodic transition in the reception signal exists during a period in which the enable signal EN is applied. If the start time point T_START is more than T3 or the end time point T_END is less than T3, the periodic transition does not exist during a period in which the enable signal EN is applied.

The enable signal generator 920 generates the enable signal EN according to at least one among many delay clocks which can be obtained by the DLL 940. In FIG. 9, the enable signal generator 920 receives the first delay clock DC1 output from the first inverter I1 and the seventeenth delay clock DC17 output from the seventeenth inverter I17. The first delay clock DC1 is a signal in which an inversion of the feedback clock signal FC is delayed by T1/2, and the seventeenth delay clock DC17 is a signal in which an inversion of the feedback clock signal FC is delayed by −T1/2. For example, the enable signal generator 920 can be realized by an SR latch 922 as shown in FIG. 9. When the seventeenth delay clock DC17 is input to an S terminal of the SR latch 922 and the first delay clock DC1 is input to an R terminal of the SR latch 922, an enable signal EN is output from a Q terminal of the SR latch 922. As another example, the enable signal generator 920 can include an inverter and a logical product operator, and in this case, an enable signal EN can be generated by ANDing an inverted signal of the seventeenth delay clock DC17 and the first delay clock DC1.

The reference clock signal generator 930 generates a reference clock signal which is a clock signal corresponding to the periodic transition by the dummy bit among many transitions of the reception signal detected by the transition detector 910.

The logical product operator 932 inputs the periodic transition by the dummy bit among transitions of the reception signal detected by the transition detector 910 to a clock terminal CLK of the flip-flop 934 by ANDing a transition of the reception signal detected by the transition detector 910 and the enable signal generated by the enable signal generator 920, during the active period.

The flip-flop 934 is a positive-edge-triggered D flip-flop. A signal (e.g., a power voltage VDD) corresponding to a bit "1" is input to an input terminal D of the flip-flop 934, an output of the logical product operator 932 is input to a clock terminal CLK, and one of delay clocks which can be obtained by the DLL 940 is input to a reset terminal RS. The flip-flop 934 outputs "1" until "1" is input to the reset terminal RS from when a rising edge of a signal input to the clock signal CLK as a reference clock signal is generated.

The delay unit 950 can include a plurality of inverters and delays the transmission clock signal.

The switch 960 applies the reference clock signal generated by the reference clock signal generator 930 during the active period, and applies the transmission clock signal delayed by the delay unit 950 to the DLL 940 during the blank period.

The DLL 940 generates the sampling clock signal CLK_SAM from the reference clock signal received from the reference clock signal generator 930 during the active period, and generates the sampling clock signal CLK_SAM from the reception clock signal received from the delay unit 950 during the blank period.

The phase detector 942 detects a phase difference between the reference clock signal and a transition of the feedback clock signal FC or a phase difference between the reception clock signal and a transition of the feedback clock signal FC, and outputs a voltage signal which is in proportion to the detected phase difference to the loop filter 944. The loop filter 944 generates a control voltage by removing or reducing a high-frequency component from the voltage signal output from the phase detector 942.

The delay line 946 generates the sampling clock signal CLK_SAM by delaying the reference clock signal according to the control voltage. The delay line 946 includes a plurality of inverters I1 to I18. Each delay of a plurality of inverters I1 to I18 is adjusted according to the control voltage input from the loop filter 944. For example, when the control voltage is increased, each delay of a plurality of inverters I1 to I18 can be reduced. Each of a plurality of inverters I1 to I18 has a delay corresponding to about T1/2. Third, fifth, seventh, ninth, eleventh, thirteenth, fifteenth, and seventeenth delay clocks DC3, DC5, DC7, DC9, DC11, DC13, DC15, and DC17 respectively output from third, fifth, seventh, ninth, eleventh, thirteenth, fifteenth, and seventeenth inverters I3, I5, I7, I9, I11, I13, I15, and I17 are output to the sampler 240 as the sampling clock signal CLK_SAM.

The present invention can be implemented as computer readable codes in a computer readable record medium. The computer readable record medium includes all types of record media in which computer readable data are stored. Examples of the computer readable record medium include a ROM, a RAM, a CD-ROM, a magnetic tape, a floppy disk, and an optical data storage. In addition, the computer readable record medium may be distributed to computer systems over a network, in which computer readable codes may be stored and executed in a distributed manner. A function program, codes and code segments for implementing the present invention can be easily inferred by programmers of a technical field pertaining to the present invention.

The display device and method according to the present invention has an advantage of being capable of transmitting the clock signal without using a separate clock line separated from the data line.

The display device and method according to the present invention has an advantage of being capable of transmitting the clock signal without using a separate clock line and thus removing an EMI component generated from a separate clock line.

The display device and method according to the present invention has an advantage of being capable of transmitting the clock signal and the control bit together through the data line during the blank period.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A display device, comprising:

a data line;

a timing controller configured to apply a transmission signal corresponding to data bits to the data line during an active period in which the data bits are transmitted, and to apply a transmission clock signal to the data line during a blank period in which the data bits are not transmitted; and a data driver configured to form a reception signal by sampling the transmission signal applied through the data line to recover the data bits and drive a display panel according to the recovered data bits.

2. The display device of claim 1, wherein the data driver generates a sampling clock signal according to the transmission clock signal applied through the data line, and samples the reception signal according to the generated sampling clock signal to recover the data bits.

3. The display device of claim 2, wherein the transmission clock signal has a cycle corresponding to an integer multiple of a period corresponding to one bit of the transmission signal.

4. The display device of claim 2, wherein the transmission signal has a periodic transition.

5. The display device of claim 2, wherein the timing controller transmits an active signal representing one of the active period and the blank period to the data driver.

6. The display device of claim 2, wherein the timing controller applies the transmission clock signal including at least one control bit to the data line during the blank period, and the data driver samples the control bit according to the generated sampling clock signal and generates a control signal corresponding to the sampled control bit.

7. The display device of claim 6, wherein the control bit is proximate a falling edge of the transmission clock signal.

8. The display device of claim 6, wherein the control bit is a polarity information bit, and the data driver generates a polarity control signal corresponding to the polarity information bit and selects one of a positive voltage and a negative voltage in the process of converting the recovered data bits into analog data according to the generated polarity control signal.

9. The display device of claim 6, wherein the data driver comprises:

a clock generator configured to generate the sampling clock signal according to the transmission clock signal applied through the data line during the blank period;

a sampler configured to sample the control bit applied through the data line during the blank period using the generated sampling clock signal; and a control signal generator configured to generate the control signal corresponding to the sampled control bit.

10. The display device of claim 6, wherein the timing controller applies a comma pattern to the data line, and the data driver detects the applied comma pattern, and samples the control bit according to the generated sampling clock signal when a period corresponding to a predetermined bit elapses from the detected comma pattern.

11. The display device of claim 10, wherein the comma pattern is proximate a falling edge of the transmission clock signal.

12. The display device of claim 1, wherein the timing controller comprises:

a serializer configured to generate serialized transmission bits corresponding to the data bits;

a clock generator configured to generate the transmission clock signal; and a multiplexer configured to output the generated transmission bits during the active period and output the generated transmission clock signal during the blank period.

13. The display device of claim 1, wherein the data driver comprises:

a clock generator configured to generate a sampling clock signal according to the transmission clock signal applied through the data line during the blank period; and a sampler configured to sample the reception signal applied through the data line during the active period according to the generated sampling clock signal to recover the data bits.

14. The display device of claim 13, wherein the clock generator changes a phase of the sampling clock signal during the blank period and maintains a phase of the sampling clock signal during the active period.

15. A display method, comprising:

at a timing controller, transmitting a transmission clock signal through a data line during a blank period in which data bits are not transmitted;

at the timing controller, transmitting a transmission signal corresponding to the data bits through the data line during an active period in which the data bits are transmitted;

at a data driver, receiving the transmission clock signal through the data line and generating a sampling clock signal according to the transmission clock signal;

at the data driver, receiving the transmission signal through the data line and sampling the received transmission signal according to the generated sampling clock signal to recover the data bits; and at the data driver, driving a display panel according to the recovered data bits.

16. The display method of claim 15, wherein the transmission clock signal has a cycle corresponding to an integer multiple of a period corresponding to one bit of the transmission signal.

17. The display method of claim 15, wherein the transmission signal has a periodic transition.

18. The display method of claim 15, further comprising:

at the timing controller, transmitting the transmission clock signal including at least one control bit through the data line during the blank period;

at the data driver, receiving the transmission clock signal including the control bit through the data line and sampling the control bit according to the generated sampling clock signal; and generating a control signal corresponding to the sampled control bit.

* * * * *